United States Patent [19]

Piotrowski

[11] 4,145,672

[45] Mar. 20, 1979

[54] MICROWAVE FERRITE CIRCULATOR HAVING DIELECTRIC TUBE FOR HOUSING CIRCULATOR ELEMENTS

[75] Inventor: Wieslaw S. Piotrowski, Los Angeles, Calif.

[73] Assignee: TRW Inc., Redondo Beach, Calif.

[21] Appl. No.: 741,370

[22] Filed: Nov. 12, 1976

[51] Int. Cl.[2] ..... H01P 1/38

[52] U.S. Cl. ..... 333/1.1; 333/261

[58] Field of Search ..... 333/1.1; 343/785

[56] References Cited

U.S. PATENT DOCUMENTS

| | | | |
|---|---|---|---|
| 2,624,003 | 12/1952 | Iams | 343/785 X |
| 3,414,843 | 12/1968 | Jansen | 333/1.1 |
| 3,662,291 | 5/1972 | Cotter | 333/1.1 |
| 3,928,824 | 12/1975 | Takahashi et al. | 333/1.1 |

FOREIGN PATENT DOCUMENTS

| | | | |
|---|---|---|---|
| 11022 | 5/1968 | Japan | 333/1.1 |

*Primary Examiner*—Paul L. Gensler
*Attorney, Agent, or Firm*—Robert W. Keller

[57] ABSTRACT

A microwave ferrite circulator includes a housing having three waveguide parts and a dual turnstile ferrite rotator. The ferrite rotator rotates an input signal through 120° and consists of a dual arrangement of a dielectric transformer, a ferrite element disposed in a dielectric tube-shaped housing along with a conductive spacer. Accordingly the rotator when assembled is of a unitary construction and is held between two conductive transformers secured to the housing.

8 Claims, 4 Drawing Figures

MICROWAVE FERRITE CIRCULATOR HAVING DIELECTRIC TUBE FOR HOUSING CIRCULATOR ELEMENTS

BACKGROUND OF THE INVENTION

This invention relates generally to ferrite circulators and particularly relates to circulators suitable for the microwave region.

Ferrite circulators of the type to which the present invention relates have been disclosed, for example, in the patent to Chait et al. U.S. Pat. No. 3,089,101.

Prior circulators have utilized large triangular structures in the junction of a three or multiple port waveguide. This usually presents manufacturing problems because the triangular structure must be precisely aligned and must be secured by some bonding material. This in turn increases the insertion loss. Other circulators which have been proposed for the frequency range under discussion have utilized a single cylindrical junction, thus minimizing the manufacturing problem. On the other hand, they have required a waveguide of decreased height, that is a non-standard waveguide. The reason for this arrangement was that it was believed to be impossible to obtain the required 120° rotation and large bandwidth in a standard size waveguide.

For many applications, such as in power amplifiers, solid state amplifiers or receiver-transmitter diplexers it is necessary to provide a circulator having low insertion loss and a large bandwidth. It is therefore an object of the present invention to provide a ferrite circulator suitable for the millimeter wave range which provides low insertion loss and a relatively large bandwidth.

Another object of the present invention is to provide a circulator of the type discussed which can be simply manufactured and which requires no bonding material.

A further object of the present invention is to provide a ferrite circulator utilizing only cylindrically-shaped parts to facilitate manufacturing thereof and to reduce the quality control problem.

SUMMARY OF THE INVENTION

In accordance with the present invention a ferrite circulator suitable for the Ka or Ku band, that is for the microwave region, includes a housing having a central region and a standard three-port waveguide configuration and a 120° rotator which includes two dielectric transformers shaped like a rod, two ferrite elements each having the shape of a rod and a conductive spacer. These elements are contained in a dielectric housing of tube shape which receives the transformers, ferrite elements and spacer to form a self-contained unit of cylindrical shape. This unit is maintained between two conductive transformers which preferably have a central cylindrical opening to receive the housing. The two transformers in turn are secured to the junction or central point of the waveguide. Finally, magnetic means are provided for generating a magnetic field along the axis of the housing.

The amount of rotation and the frequency range is determined by the strength of the magnetic field, and by the diameter and length of the ferrite elements.

The novel features that are considered characteristic of this invention are set forth with particularity in the appended claims. The invention itself, however, both as to its organization and method of operation, as well as additional objects and advantages thereof, will best be understood from the following description when read in connection with the accompanying drawing.

DESCRIPTION OF THE PREFERRED EMBODIMENTS

Figure 2:
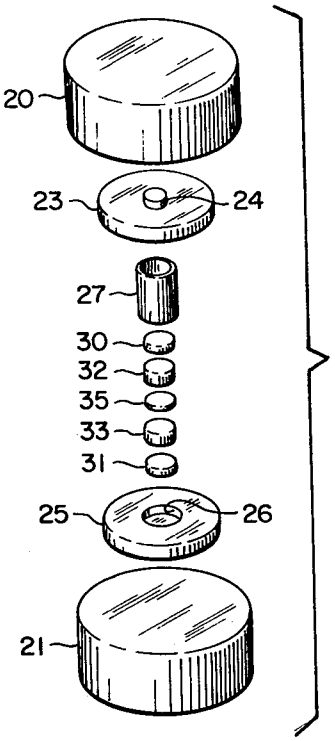
FIG. 2 is an exploded view on enlarged scale of the ferrite rotator, its component parts and a pair of permanent magnets which will fit the waveguide circulator of FIG. 1.
Figure 1:
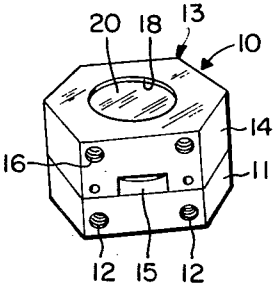
FIG. 1 is a view in perspective of a three port waveguide circulator suitable for the Ka band in accordance with the present invention.

Referring now to the drawing and particularly to FIGS. 1 and 2, there is illustrated a waveguide circulator 10 of the standard three port type suitable for the Ka frequency range. The waveguide circulator 10 comprises a housing 13 formed by a bottom plate 11 and a top plate or portion 14, the bottom plate 11 which may be provided with internal threads 12 for attachment to a standard waveguide flange.

As illustrated, the bottom plate 11 mates with the top portion 14 provide three ports for attachment to rectangular waveguides, one of which is shown at 15. These rectangular waveguides will propagate the $TE_{1,0}$ mode. The upper waveguide portion 14 may be slotted or milled to provide the three ports. It may also be provided with a plurality of internal threads 16 for attachment to a standard waveguide flange. As shown in FIG. 1, the top waveguide structure 14 is provided with a central depression 18 for housing a permanent magnet as will be more fully described hereinafter.

The actual circulator structure is shown on enlarged scale in FIG. 2 which is an exploded view. The circulator includes a top magnet 20 and a bottom magnet 21, one of which fits the central aperture 18 in the top waveguide housing 14. The remaining circulator structure, as clearly shown in FIG. 2, has a common central axis and includes a conductive transformer 23 which is generally disk-shaped as shown and has an upper boss 24 which fits a suitable cylindrical recess in the inner surface of the central region of the top plate 14. There is also provided a second conductive transformer 25 which is at the other end of a circulator structure and which also includes a boss 24 and is secured to a similar cylindrical opening in the bottom plate 11 and on its surface opposed to the boss has a central cylindrical aperture 26 into which fits a housing or sleeve 27 which is tube shaped and consists of a dielectric material. It will, of course, be understood that both transformers 23 and 25 are provided each with a boss 24 and a central depression 26. The two conductive transformers 23 and 25 serve the purpose to match the impedance of the waveguide ports to the impedance of the rotator.

There is further provided a first and a second dielectric transformer 30 and 31 disposed at opposite ends. Each dielectric transformer consists of a rod or disk. This is followed by a pair of ferrite elements 32 and 33 which are also rod shaped. Finally, a spacer element 35 is provided to separate the dual turnstiles, each being formed by the dielectric transformer 30 and ferrite element 32 or dielectric transformer 31 and ferrite element 33 respectively.

The spacer 35, which may also be called a septum, is a small metallic disk which may, for example, have a thickness of 2 mils (0.002"). The outer diameters of elements 30, 31, 32 and 35 are equal and are such that they fit the cylindrical opening of the housing 27. Each of the dielectric transformers 30 or 31 may have a thickness of between 7 and 25 mils.

The frequency range and rotation of an input signal are determined by the strength of the magnetic field generated by the magnets 20, 21 and by the length and diameter of each of the two ferrite elements 32 and 33. The magnetic field generated by the two magnets 20 and 21 extends in the direction of the central axis of the rotation.

It will readily be appreciated that when the elements 30, 31, 32, 33 and 35 are inserted into the housing 27 they form a self-contained unit which need not be bonded.

By way of example, the conductive transformers 23 and 25 may consist of a suitable metal such, for example, as copper or brass. The dielectric transformers 30 and 31 may consist of a material having a low dielectric constant such, for example, as polytetrafluoroethylene also known in the trade as Teflon. The spacer 35 may consist of a copper shim. The dielectric tube 27 may consist of the same material as do the transformers 30 and 31.

The circulator operates in a conventional manner. The incoming signal is broken up into three components or modes, two of which rotate in opposite directions. The third mode may be called the dielectric mode and is controlled by the length of the ferrite. This length should correspond to $\frac{2}{3}\pi$ to provide a 120° phase shift.

For wideband operation the ferrite should produce the fundamental mode which requires a small length of ferrite. This is the reason why in accordance with the present invention a dual turnstile is provided. It has actually been found that with this construction twice the normal bandwidth can be obtained.

Tests have proven that the isolation between the ports for the input and output signal and the third port is between −35 and −25 db. The VSWR is less than 1.1:1 while the insertion loss is only between 0.08 and 0.13 db. Tests have been made in a standard WR-28 waveguide covering the range between 26.5 and 40 Ghz. It has also been found to be operable in the frequency ranges from 12.4 to 18 Ghz, and from 18 to 26.5 Ghz. The high isolation to the unused port, minimum insertion loss, and minimum VSWR is true of a large frequency range in excess of 25%.

Figure 4:
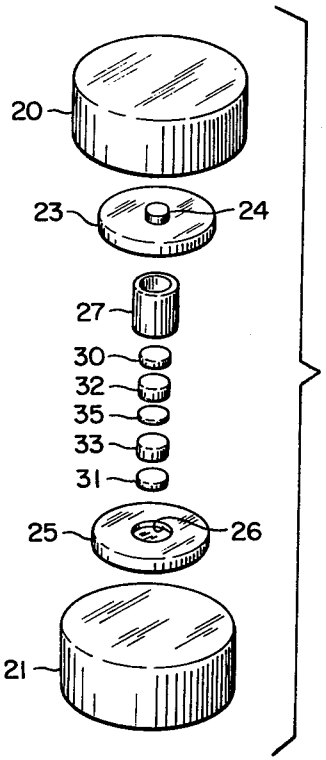
FIG. 4 is an exploded view on enlarged scale similar to that of FIG. 2 and illustrating again the ferrite rotator and associated parts, as well as the two magnets required for the ferrite circulator of the invention.
Figure 3:
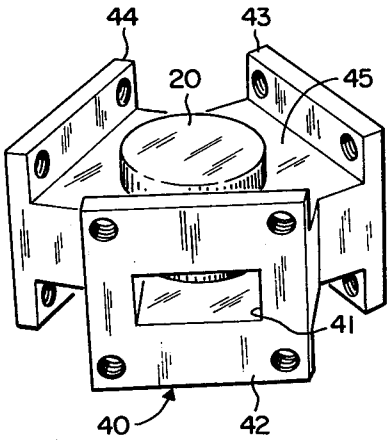
FIG. 3 is a view in perspective on another three port standard waveguide circulator suitable for the Ku range in accordance with the present invention.

Referring now to FIGS. 3 and 4, there is shown another type of waveguide circulator 40 suitable for the Ku range. The waveguide circulator includes a housing having opposed inner surfaces forming a central region and including three ports, one of which is shown in 41. The housing structure has three flat plates 42, 43 and 44 provided with suitable internal threads for attachment to standard waveguide flanges. The magnet 20 may be secured to a suitable opening in the top plate 45. Another magnet such as 21 is similarly attached to the bottom of the structure.

This circulator operates in the same manner as that previously described and the parts illustrated in FIG. 4 are identical to those of FIG. 2 except for their dimensions which are slightly larger to correspond to the larger waveguide. They have also been given the same reference numbers.

There has thus been disclosed a microwave ferrite circulator providing large isolation to the unused port, a very low VSWR in the operating band and a very large bandwidth on the order of 25%. The circulator does not require any bonding material, thus minimizing the insertion loss. Furthermore, the structure is self-indexing and self-contained and hence presents a minimum of adjustment problems and ease of manufacture.

What is claimed is:

1. A waveguide circulator comprising:

a housing including opposed inner surfaces forming a central region and including at least three waveguide ports;

first and second transformers formed of conductive material and having opposed outside and inside surfaces, said outside surfaces being respectively mounted against said opposed inner surfaces in said central region and said inside surfaces each including securing means;

third and fourth transformers formed of dielectric material;

first and second ferrite elements;

a spacer formed from conductive material, said third and fourth transformers, said first and second ferrite elements and said spacer each having an outer perimeter with a generally similar shape;

an elongated hollow member formed of a dielectric material and having a configuration for carrying said spacer, said third and fourth transformers, and said first and second ferrite elements, said member being disposed between said opposed inside surfaces and secured by said securing means without requiring bonding material, whereby when a signal is applied to a first of said ports and a magnetic field is generated axially through said first and second transformers and said member, the signal is rotated to a second port.

2. A waveguide circulator as recited in claim 1 wherein said hollow member has a generally tubular shape and wherein said third and fourth transformers, said first and second ferrite elements and said spacer each have a generally circularly shaped outer perimeter.

3. A waveguide circulator as recited in claim 1 wherein said securing means forms a central recess, said member being disposed with its opposed end surfaces in said recesses so as to firmly secure said member between said first and second transformers.

4. A waveguide circulator as recited in claim 1 wherein said spacer is carried in the middle portion of said hollow member and said third and fourth transformers and said first and second ferrite elements are symmetrically arranged with respect to said spacer.

5. A waveguide circulator as recited in claim 1 wherein said opposed inner surfaces each include a central opening and wherein said outside surfaces each include a raised portion capable of being inserted through said respective central openings, said raised portions being inserted into said openings and serving to secure said first and second transformers to said housing.

6. A waveguide circulator as recited in claim 5 wherein said securing means forms a central recess, said member being disposed with its opposed end surfaces in said recesses so as to firmly secure said member between said first and second transformers.

7. A waveguide circulator as recited in claim 1 wherein said housing includes three waveguide ports and wherein said third and fourth transformers, said first and second ferrite elements and said spacer provide a 120° rotator.

8. A waveguide circulator as recited in claim 1 and further comprising means disposed on said housing for generating a magnetic field axially through said first and second transformers and said member.

* * * * *